US005297488A

United States Patent [19]

Bunch, Jr.

[11] Patent Number: 5,297,488

[45] Date of Patent: Mar. 29, 1994

[54] APPARATUS FOR SELECTIVE RANDOM PRINTING OF FIXED DATA

[75] Inventor: Earnest B. Bunch, Jr., Phoenix, Ariz.

[73] Assignee: B. Bunch Company, Inc., Phoenix, Ariz.

[21] Appl. No.: 967,016

[22] Filed: Oct. 26, 1992

[51] Int. Cl.[5] ..... B41F 5/06; B41F 13/28

[52] U.S. Cl. ..... 101/182; 101/247

[58] Field of Search ..... 101/182, 181, 219, 228, 101/233, 234, 247, 178, 138, 139, 227, 183, 184, 185

[56] References Cited

U.S. PATENT DOCUMENTS

| | | | |
|---|---|---|---|
| 2,893,310 | 7/1959 | Johnson | 101/248 |
| 4,108,067 | 8/1978 | Werner | 101/182 |
| 4,541,337 | 9/1985 | Schaul | 101/227 |

*Primary Examiner*—J. Reed Fisher

*Attorney, Agent, or Firm*—Rod R. Nissle

[57] ABSTRACT

Apparatus for printing images on certain randomly selected ones of the pre-printed pages comprising a web. The pages are attached to one another end to end to form the web. The apparatus imprints in specific defined areas on the pre-printed pages fixed data in a color other than the color of the pre-printed information on the pages.

4 Claims, 10 Drawing Sheets

APPARATUS FOR SELECTIVE RANDOM PRINTING OF FIXED DATA

This invention relates to printing apparatus.

More particularly, the invention relates to apparatus which prints company trademarks or other images on certain randomly selected ones of the pages comprising a web, the pages being attached to one another end-to-end to form the web.

In a further respect, the invention pertains to apparatus of the type described which can imprint in specific defined areas of only a limited random number of the pre-printed pages in a web company names, logos, or other fixed data in a color other than the color of the pre-printed information on the pages.

In another respect, the invention pertains to apparatus of the type described which can produce at a high rate of speed in excess of two hundred feet a minute business forms, the business forms including material pre-printed on the forms by a laser printer and including colorized company names or other supplemental fixed data which is imprinted on the forms subsequent to the pre-printed material.

Apparatus and methods for producing pre-printed business forms are well known in the art. Such apparatus typically processes a web comprised of pages of paper or similar material attached end-to-end. Each page comprises a copy of an invoice or other business form and, accordingly, a roll of the web comprises duplicate copies of the form attached end-to-end. After a pre-printed roll of business forms is prepared, the web is run through a printing machine to print a selected company name or logo in a selected area (normally the top) of the business form. The foregoing prior art process for producing pre-printed business forms has several drawbacks. First, the company name or logo must be printed on each form. Second, the forms on the roll must each have the same number of pages. Usually the number of pages in a form is one. Third, when a laser printer pre-prints material on a business form and a second printer imprints supplemental colorized fixed data on the form, only two different colors ordinarily are used with each form, one color for the material pre-printed by the laser printer and a second color for the fixed data. Fourth, the color of ink used for the company name or logo is not readily altered while the prior art apparatus is being run and is "on-line". Fifth, when paper fed into a laser printer includes images earlier printed on the paper, the ink from the images tends to foul and contaminate the printing mechanisms of the laser printer.

Accordingly, it would be highly desirable to provide an improved printing method and apparatus which could simultaneously pre-print business forms and imprint the forms with a company name, logo, or other fixed data; which could randomly imprint only certain pages in each form with a company name or logo; which could imprint a company name or logo on business forms that are on a single web and that include different numbers of pages; that would permit the color of ink used to print a company name or logo on a business form to readily be altered while the forms were running on line; and, that would minimize the contamination of the printing mechanisms in a laser printer by enabling business forms to be produced by feeding into the laser printer clean paper which had not previously been imprinted.

Therefore, it is a principal object of the invention to provide an improved printing apparatus and method.

A further object of the invention is to provide improved printing apparatus which simultaneously imprints business forms on the pages in a web and imprints colored company names or logos on the business forms.

Another object of the invention is to provide improved printing apparatus which imprints a company name and logo or other fixed data at a selected location on each of a randomly selected number of pages in a web.

Still a further object of the invention is to provide improved printing apparatus which permits the color of ink used to print a company name or logo on a pre-printed business form to be altered in situ while the forms are being pre-printed and fixed data is being applied to a web of paper moving through the printing apparatus.

Yet another object of the invention is to provide improved printing apparatus which permits the company name, logo or other fixed data to be imprinting at a selected location on the first page of each of a plurality of jobs pre-printed on a web, the web being comprised of pages attached end-to-end and the jobs being of differing lengths and being comprised of varying numbers of pages.

These and other, further and more specific objects and advantages of the invention will be apparent to those skilled in the art from the following detailed description thereof, taken in conjunction with the drawings, in which.

Briefly, in accordance with my invention, I proved an improved apparatus for printing images on a web comprised of a plurality of pages attached end-to-end. The apparatus includes a control system for receiving instructions defining at least first and second images each to be printed on at least one of two successive pages in the web and for generating printing format signals. The printing format signals include information defining the first and second images and specifying on which of the two pages each of the images is to be imprinted. A laser printer is responsive to the printing format signals to print the first image on at least one of the two successive pages. A mechanism is provided for feeding the web into the laser printer. A plate ink printing machine is on line with the laser printer and includes a frame, a reservoir of ink mounted on the frame, an imprint roller with at least one plate for imprinting the second image on the web, and a mechanism for transporting ink from the reservoir to the plate on the imprint roller. The imprint roller is rotatably mounted on the frame means for displacement in at least one direction generally perpendicular to the longitudinal axis of the imprint roller. A roller activation mechanism is mounted on the frame of the plate printing machine and is responsive to the printing format signals to displace the imprint roller in said one direction at a selected time to press the plate against the web and imprint the second image on one of the two sequential pages. Apparatus is included for transporting the web so that the web simultaneously moves through the laser printer and the plate printing machine.

Figure 1:
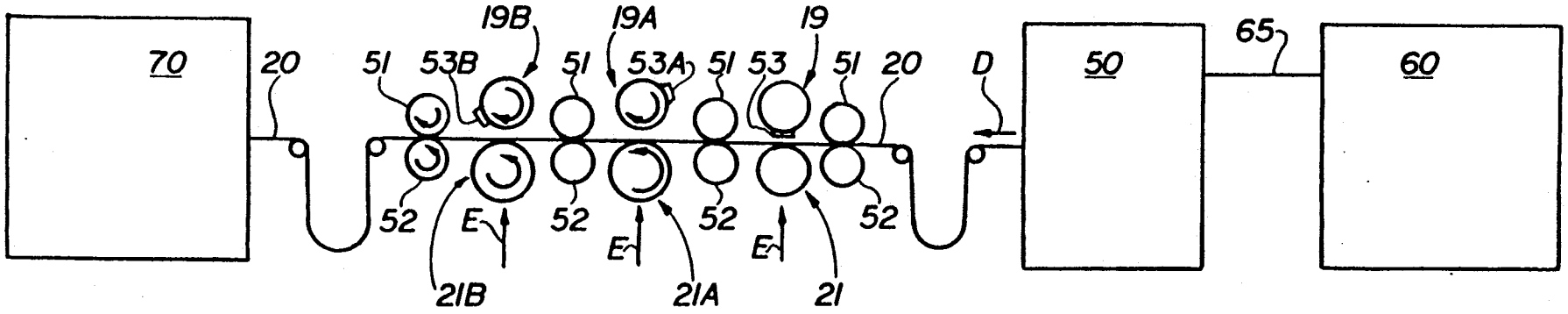
FIG. 1 is a diagram illustrating printing apparatus constructed in accordance with the principles of the invention.

Turning now to the drawings, which depict the presently preferred embodiments of the invention for the purpose of illustrating the practice thereof and not by way of limitation of the scope of the invention, and in which like reference characters represent corresponding elements throughout the several views, FIG. 1 illustrates a printing apparatus constructed in accordance with the principles of the invention and including a main frame computer 60 which transmits 65 job definition information to a control unit in laser printer 50. Computer 60 can be located on site or at a location remote from printer 50. The job definition information defines the information which is to be printed on a web 20 which is fed into and moving through printer 50. The information which is to be printed on web 20 consists of letters, numbers, drawings or other images. If the job is simply a report, the information may consist solely of letters, i.e., words. If the job which is to be printed on pages in web 20 consists of a business form, the information may consist of a combination of letters, numbers, and drawings. The job definition information also defines the number of pages in the job and what portion of the images in the job goes on each page in the job. Further, the job definition information can indicate what auxiliary information is to be imprinted on web 20 by a printer other than printer 50, as well as define where on the web the auxiliary information will appear.

The mechanism for feeding paper into printer 50 can be integrated into printer 50 or can comprise another apparatus operatively associated with printer 50. By way of example, printer 50 can comprise an IBM 3800 laser printer including a photoconducting drum that provides the printing on the web 20. The web can comprise paper or some other material. The photoconducting drum is not illustrating in the drawings. Printer 50 can comprise any prior art printer, but preferably comprises a printer which can receive electronic signals defining the data to be printed, translate the signals into images, and print the images on web 20.

In FIG. 1, web 20 exits printer 50 in the direction of arrow D after printer 50 has pre-printed selected pages on web 20 with a particular job. The pre-printed web 20 moves sequentially through a series of plate printers. The first plate printer includes a rotating roller 19 provided with a plate 53, and includes a rotating roller 21. Means (not shown) are provided for upwardly displacing roller 21 in the direction of arrow E at selected times. Roller 21 is upwardly displaced to press web 20 against plate 53. A selected image(s) is engraved or otherwise fixed in plate 53.

The second plate printer includes a rotating cylindrical roller 19A provided with a plate 53A, and includes a rotating cylindrical roller 21A. Means (not shown) are provided for upwardly displacing roller 21A in the direction of arrow E at selected times. Roller 21A is upwardly displaced to press web 20 against plate 53A.

The third plate printer includes a rotating cylindrical roller 19B provided with a plate 53B, and includes a rotating cylindrical roller 21B. Means (not shown) are provided for upwardly displacing roller 21B in the direction of arrow E at selected times. Roller 21B is upwardly displaced to press web 20 against plate 53B.

Rollers 21, 21A, 21B are rotated such that the speed of travel of a point on the outer cylindrical surface of each roller is equal to the speed of travel of web 20. Rollers 19, 19A, 19B are rotated such that the speed of travel of plates 53, 53A, 53B are equal to the speed of travel of web 20.

The color of ink used on one of plate 53, 53A, 53B is typically, but not necessarily, different from the color of ink used on the remaining two of plates 53, 53A, 53B.

Opposed roller pairs 51, 52 propel web 20 from printer 50 through the plate printers and into spiral folding machine 70. Any desired means can be utilized to move web 20 through printer 50, the plate printers, and into spiral paper folder 70.

In FIG. 1, only a portion of each plate printer is, for sake of clarity, illustrated. Each plate printer in FIG. 1 is identical in construction, except the images fixed in one plate 53, 53A, 53B are usually, but not necessarily different than the images fixed in the remaining two plates 53, 53A, 53B. The remaining operatively associated portion of plate printer 19, 21 in FIG. 1 are illustrated in more detail in FIGS. 2 to 4. The plate printer of FIG. 1 includes fountain means 11, fountain roller 14, ductor roller 15, distributor roller 16, form rollers 17 and 18, plate or imprinting roller 19, and displaceable support roller 21. Fountain means 11 includes a plate or blade 13 which supports in part a reservoir 12 of ink. The lower edge of blade 13 is adjacent the smooth outer cylindrical surface of fountain roller 14. Roller 14 draws ink 12 along its surface 22 intermediate the lower edge of blade 13. Roller 14 is fixedly attached to and rotates simultaneously with shaft 23.

Ductor roller 15 is fixedly attached to and simultaneously rotates with shaft 24. The outer cylindrical surface 25 of ductor roller 15 is spaced apart from surface 22 of roller 14 and from the outer smooth cylindrical surface 26 of distributor roller 16. Resilient longitudinal strip 27 extends the length of ductor roller 15 and is parallel to the longitudinal axis of roller 15 and to elongate shaft 24. Strip 27 extends outwardly from surface 25 a distance sufficient for strip 27 to bridge the gap between rollers 14, 15 at their closest approach and for strip 27 to "kiss" surface 22 to remove ink from surface 22 onto strip 27. The distance between rollers 15 and 16 at their point of closest approach is about equal to the distance between rollers 14 and 15 at their closest approach such that strip 27 can bridge the gap between rollers 15, 16 and apply ink to surface 26 of the distributor roller 16. Roller 16 is fixedly attached to and rotates simultaneously with elongate cylindrical shaft 28.

Form rollers 17 and 18 are fixedly attached to and rotate simultaneously with shafts 29 and 30, respectively. Imprinting roller 19 includes plate 53 or other printing means on the circumference of a cylindrical roller 32. Plate 53 typically includes fixed upraised portions which receive ink from the outer smooth cylindrical surfaces of form rollers 17 and 18 and apply the ink to the web 20 made from paper or other desired materials. Web 20 moves between roller 19 and roller 21.

Points on the surfaces of form rollers 17 and 18 typically move at the same velocity as points on the outer cylindrical surface of a distributor roller 26 and as points on the outer surface of cylindrical plane 53. Points on the outer surface of plate 53 move at about the same velocity as points on the outer smooth cylindrical surface of support roller 21. Support roller 21 is fixedly attached to and rotates simultaneously with elongate cylindrical shaft 33. Shaft 33 and roller 21 can be displaced in the direction of arrow E to press web 20 against plate 53 when plate 53 is in the position indicated by dashed lines 55 in FIG. 2. Imprinting roller 19 is fixedly attached to and rotates simultaneously with elongate cylindrical shaft 34. Elongate cylindrical shafts 23, 24, 28, 29, 30, 33, 34 are parallel to one another, as are rollers 14 to 19, 21.

Plate 53 can be fabricated from metal, rubber, or any other desired material. Rollers 14 and 15 presently are of equal diameter and rotate at the same speed to facilitate construction of the gearing which drives rollers 14 and 15. If desired, the size and speed of rotation of roller 14 can be different than those of roller 15. Rollers 14 and 15 also presently rotate in opposite directions, as indicated by arrows A and B in FIG. 2. If desired, roller 14 can rotate in the same direction as roller 15. The direction of rotation of distributor roller 16 is indicated by arrow C in FIG. 2 and presently is opposed to the direction of rotation of roller 15. The velocity of a point on the surface of distributor roller 26 normally is greater than the velocity of a point on the surface of roller 15. Consequently, when strip 27 contacts surface 26, roller 16 imparts a force to strip 27 and to roller 15 which acts to increase the speed of rotation of roller 15 in the direction of arrow B. When rollers 14 and 15 are driven by a pulley or by a gear train, there normally is no slack in the gear train and the speed of rotation of roller 15 will not increase when strip 27 contacts surface 26 of a distributor roller 16 which has a surface speed greater than the speed of movement of strip 27. In this situation, strip 27 slides over surface 26. In the embodiment of the invention shown in FIG. 4, however, the drive for rollers 14 and 15 is provided with a one-way clutch which, when strip 27 contacts the surface 26 of roller 16, permits rollers 14 and 15 to free-wheel and move at a greater than normal speed while strip 27 contacts the surface 26 of roller 16. The functioning of this one-way clutch is further described below.

Figure 2:
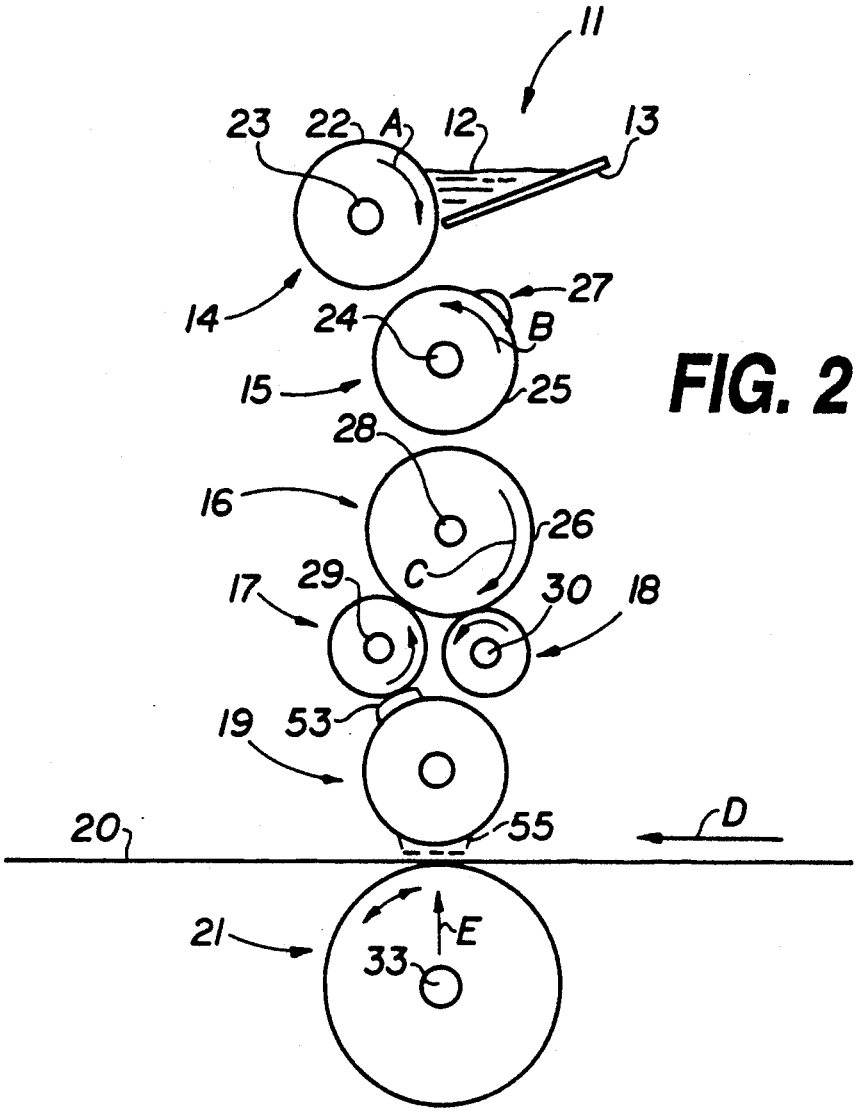
FIG. 2 is a side elevation view illustrating printing apparatus utilized in the apparatus of FIG. 1 and showing further construction details thereof.

In FIG. 2 form rollers 17 and 18 comprise downstream rollers. Downstream rollers receive ink from the distributor roller 16 and carry the ink to a desired roller station. As used herein, downstream rollers can comprise vibrator rollers, form rollers, rider rollers or any other type of roller used in a chain of rollers to transfer ink from the distributor roller 16 to a desired station roller. There can be one or more downstream rollers. There typically are four or more downstream rollers. The station roller is any roller which receives ink from the downstream roller(s). In FIG. 2, the imprinting roller 19 is a station roller.

The distributer roller 16, imprinting roller 19, and support roller 21 presently preferably are driven rollers. Form rollers 17 and 18 can be driven. During the operation of the apparatus of FIG. 2, shafts 23, 24, 28, 29, 30, 33, 34 normally maintain the spacings relative to one another which are indicated in FIG. 2, i.e., the shafts do not move in horizontal or vertical directions which lie in the plane of the sheet of paper of the drawing of FIG. 2. Shaft 33 and roller 21 are, as previously described, periodically displaced in the direction of arrow E and then returned to the position shown in FIG. 2. As would be appreciated by those of skill in the art, if roller 17 was a vibrator roller, roller 17 would move back and forth in directions which are parallel to the longitudinal axis of shaft 29 and perpendicular to the plane of the sheet of paper of the drawings.

Figure 3:
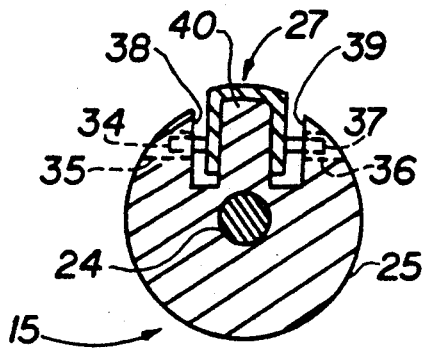
FIG. 3 is a section view illustrating one of the rollers of the apparatus of FIG. 2.

In FIG. 3, elongate parallel slots 38 and 39 are formed in roller 15 and are parallel to the longitudinal axis of roller 15. The edges of strip 27 wrap around tongue 40 and extend into slots 38, 39. Externally threaded set screws 34, 37 are turned into internally threaded apertures formed in roller 15. Set screws 34, 37 press the edges of strip 27 against the walls of tongue 40. In addition to the method shown in FIG. 3, any other desired method and apparatus can be utilized to position strip 27 on roller 15 so a portion of strip 27 extends outwardly from cylindrical surface 25 to contact both surface 22 and surface 26 during the rotation of roller 15 in the direction of arrow B. Strip 27 is resilient. Fabricating strip 27 from a hard non-compressible material like steel is not recommended in the practice of the invention. Presently, strip 27 extends a distance outwardly from surface 25 which is about 0.002 inch greater than the distance between rollers 14 and 15 at their point of closest approach. Consequently, when strip 27 contacts surface 22, strip 27 just "kisses" and is slightly compressed by surface 22, and by surface 26 when strip 27 contacts surface 26.

Figure 4:
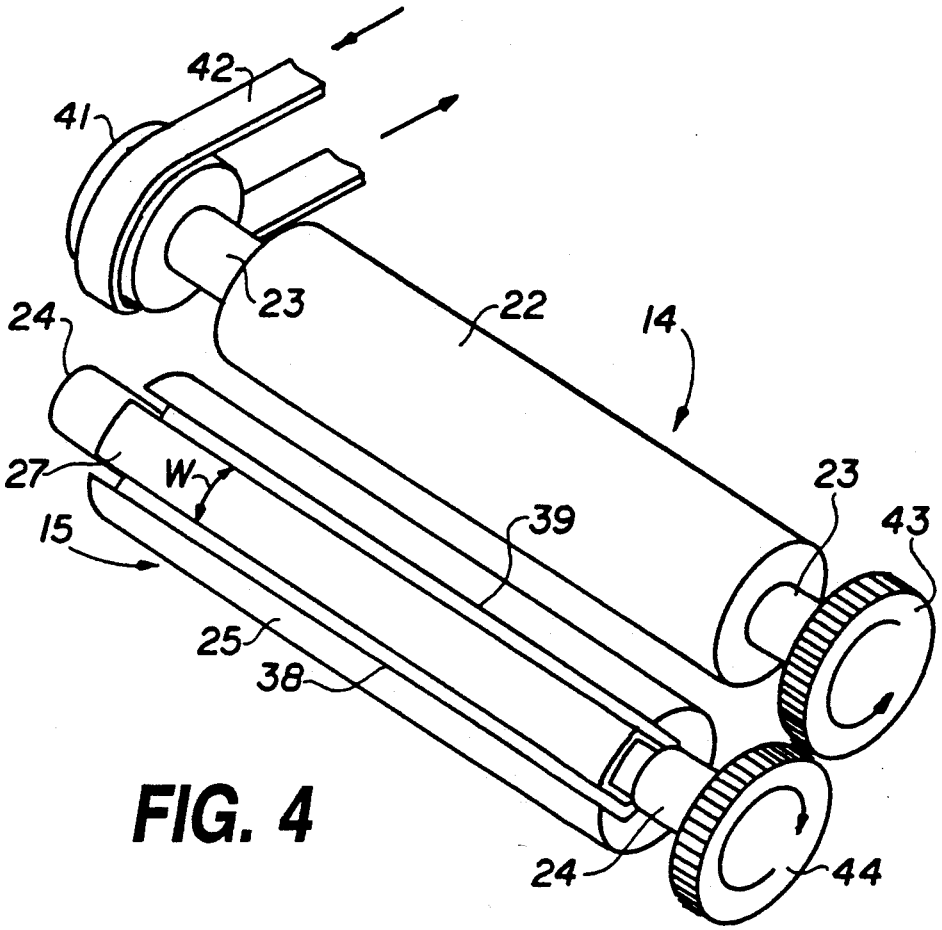
FIG. 4 is a perspective view further illustrating rollers utilized in the printing apparatus of FIG. 2.

The fountain roller 14 and ductor roller 15 are illustrated in FIG. 4 with the fountain means and other rollers in FIG. 2 omitted for the sake of clarity. Belt 42 turns one-way clutch bearing assembly 41 connected to shaft 23 of roller 14. Toothed gear 43 is attached to shaft 23. Toothed gear 44 is attached to shaft 24 of roller 15. In operation, while roller 15 is rotating and strip 27 is not in contact with surface 26 of distributor roller 16, belt 42 turns one-way clutch bearing assembly 41 and roller 14 at the same rpm. Gear 43 turns gear 44 and roller 15 and causes rollers 15 and 14 to rotate at the same speed. When strip 27 contacts surface 22 of roller 14, rollers 14 and 15 continue to turn at about the same speed as the one-way clutch bearing assembly 41. When however, strip 27 contacts surface 26 of roller 16 (not shown in FIG. 4), roller surface 26 is normally moving at a greater speed than strip 27 and surface 26 imparts a supplemental force to strip 27 which acts to increase the speed of rotation of roller 15 in the direction of arrow B. When this supplemental force is applied to strip 27, one-way clutch bearing assembly 41 permits the speed of rotation of rollers 14 and 15 to increase over the normal speed of rotation imparted by belt 42. As soon as strip 27 loses contact with surface 26, the speed of rotation of rollers 14 and 15 slows back to the normal speed of rotation imparted by belt 42. Clutch assembly 41 permits the speed of rotation of rollers 14 and 15 to be increased over the speed of rotation imparted by belt 42, but does not permit the speed of rotation to be decreased with respect to the speed of rotation imparted by belt 42. The use of one-way clutch bearing assembly 41 significantly improves the transfer of ink from strip 27 to surface 26 by enabling the speed of movement of strip 27 to temporarily be increased to match the speed of movement of the outer surface 26 of roller 16. If desired, a mechanism can be utilized in place of a one-way clutch 41 which allows the speed of strip 27 to be temporarily slowed by surface 26 when strip 27 contacts surface 26. The structure and operation of one-way clutch bearing assembly 41 is well known in the art and will not be described in detail herein. A manufacturer of one-way clutches of the type presently utilized in the invention is Torrington Company, 59 Field Street, Torrington, Conn. 06790.

Longitudinal strip 27 is presently preferably parallel to the longitudinal axis of roller 15, but can, if desired, be slightly canted with respect to the longitudinal axis of roller 15. When strip 27 is canted with respected to the longitudinal axis of roller 15, strip 27 is wound partially around roller 15 in a helical fashion. If desired, strip 15 can only extend partially across roller 15. As used herein, the term longitudinal strip includes a strip 27 parallel to the longitudinal axis of roller 15 and includes a strip which winds partially around roller 15 in helical fashion. In the practice of the invention, it is not contemplated that strip 27 continuously contact surface 22 or surface 26 while the roller 15 rotates. Strip 27 only intermittently sequentially contacts surface 22 and surface 26. Strip 27 contacts surface 22, loses contact with surface 22, then contacts surface 26, loses contact with surface 26, then contacts surface 22, etc.

In operation of the printing apparatus of FIGS. 2 to 4, fountain means 11 spreads a film of ink on the outer cylindrical surface 22 as roller 14 rotates in the direction of arrow A. Gear 43 causes roller 15 to turn at the same speed as roller 14. Each time longitudinal strip 27 moves through the closest point of approach of rollers 14 and 15, strip 27 "kisses" surface 22 and receives ink therefrom. Each time strip 27 moves through the closest point of approach of rollers 15 and 16, strip 27 kisses and transfers ink to surface 26. Ink from surface 26 travels onto the outer cylindrical surfaces of form rollers 17 and 18 and from the outer cylindrical surfaces of form roller 17 and 18 onto raised portions of the outer surface of plate 53. As plate 31 rotates with roller 19, it, when roller 21 is upwardly displaced in the direction of arrow E to press web 20 against plate 53, transfers ink from the raised portions of plate 53 onto a strip 20 of paper or other material traveling intermediate rollers 19 and 21 in the directions of arrow D.

The velocity of a point on surface 26 is greater than the velocity of strip 27. When strip 27 kisses surface 26, one-way clutch assembly 41 permits rollers 14 and 15 to free-wheel and increase their speed of rotation such that the speed of movement of strip 27 is subsequently equivalent to the speed of movement of surface 26. As soon as strip 27 loses contact with roller 16, the speed of rotation of rollers 14 and 15 slows to the speed produced when belt 42 turns roller 14.

The surfaces of rollers 14, 16, 17, 18, 21 generally comprise smooth cylindrical surfaces. Since surface 25 does not contact surface 22 or 26, surface 25 does not need to be cylindrical but can have any desired shape and dimension. Roller 15 preferably is shaped to maintain its balance while it rotates about the axis of shaft 24.

The width, W, of strip 27 can vary as desired, but presently is one-quarter to one-half inch wide.

At least rollers 14 and 15 are mounted in a portable housing which is detachable from the remainder of the printing press. Fountain means 11, roller 16, roller 17, roller 18, roller 19, and/or roller 21 can be mounted in the portable housing along with rollers 14 and 15. In the presently preferred embodiment of the invention, fountain means 11 and rollers 14 to 18 are mounted together in a portable housing. Shafts 23, 24, 28, 29, 30 are journalled for rotation in the housing.

While shafts 23, 24, 28, 29, 30, 33, 34 normally maintain the spacings relative to one another while the apparatus of FIG. 2 is operating, shafts 23, and 24 can be mounted on a frame which permits the fixed distance which roller 15 maintains from roller 14 during operation of the apparatus of FIG. 2 to be adjusted while the machine is being set up for operation. After the ductor roller 15 is adjusted to achieve the desired distance between rollers 14, 15, the position of shaft 24 is fixed such that during operation of the apparatus of FIG. 2 the distance between rollers 14 and 15 is fixed and maintained. The position of the support frame in which the rollers 14, 15 are rotatably mounted, and in which shaft 24 is adjustably rotatably mounted in the manner just noted, can also be adjusted such that the fixed distances which rollers 14, 15 maintain from roller 16 during the operation of the apparatus of FIG. 2 can simultaneously be adjusted. Once the desired distances from rollers 14, 15 to roller 16 is achieved, the adjustable support frame carrying rollers 14, 15 is fixed in position such that the distance between rollers 15 and 16 and the distance between rollers 14 and 16 is maintained during operation of the apparatus of FIG. 2. The afore-described adjustability of rollers 14 and 15 with respect to roller 16 can be achieved using prior art housing and gearing systems and such housing and gearing systems will not be described herein. It is only important that in the practice of the invention such adjustable mounting of roller 15 and of rollers 14 and 15 in tandem during set-up of the apparatus furthers the practical use of the invention.

In order for a plate printer 19, 21 to imprint at the correct location on a page the image fixed in plate 53, the plate printer must know how long it takes for a page to travel from printer 50 to the plate printer and must know where on the page plate 53 needs to imprint the image. As would be appreciated by those of skill in the art, a variety of sensors and methods are available which enable the plate printer 19, 21 to keep track of the location of each page of paper in web 20 which is dispensed by printer 50. In the method presently utilized in the practice of the invention, the control unit of printer 50 sends a pulse or "count" to the control unit for the plate printer each time a one-sixth inch length of paper is dispensed by printer 50 in the direction of arrow D. The control unit of the plate printer 19, 21 adds the counts received from printer 50 and subtracts a count from this total each time the plate printer dispenses a one-sixth inch length of paper from printer 19, 21 and in the direction of plate printer 19A, 21A. When printer 50 receives job definition information from computer 60 and is printing a job on web 20, the control unit of printer 50 transmits a placement signal to plate printer 19, 21 when the page being pre-printed by printer 50 requires that the company name, logo, or other fixed data engraved on plate 53 be imprinted on the page being pre-printed. The placement signal presently simply indicates to plate printer 19, 21 only that the company name or other data fixed on plate 53 must go on a certain page. The placement signal does not indicate to printer 19, 21 the location of the fixed data on the page because such location is predetermined by the placement of plate 53 on roller 19 and by the portion of the page which is adjacent plate 53 when the page is intermediate rollers 19, 21 and plate 53 is in the position indicated by dashed lines 55 in FIG. 2. Roller 19 makes one revolution each time a page passes through printer 19, 21. When plate printer 19, 21 receives a placement signal from printer 50, printer 19, 21 knows that it must decrement a selected number of counts before the page which must be imprinted by plate 53 reaches printer 19, 21. The number of counts which printer 19, 21 must decrement is a fixed value known in advance and generally equals the distance a page must travel from printer 60 to reach printer 19, 21 divided by six. Consequently, after plate printer 19, 21 receives a placement signal from printer 50 and then decrements the selected number of counts, roller 21 is upwardly displaced in the direction of arrow E to press web 20 against plate 53. Since roller 19 makes one revolution each time one page of web 20 passes through printer 19, 21, plate 53 generally can only imprint a page at one specified location on the page. In other words, each time plate 53 is in the position indicated by dashed lines 55 in FIG. 2, plate 53 is directly above a selected area on the page beneath plate 53. Each time a new page passes beneath roller 19, plate 53 is, when plate 53 is in the position indicated by dashed lines 55, over the same area on that new page as plate 53 was over for each page which earlier passed beneath roller 19 in the direction of arrow D. The circumference of the circular path along which plate 53 travels is equal to the length of each page in web 20. The shortest distance between lines of weakening 80 bounding page 70 equals the shortest distance between the lines of weakening 80 bounding page 71, equals the shortest distance between the lines of weakening 80 bounding page 72, etc.

Figure 5:
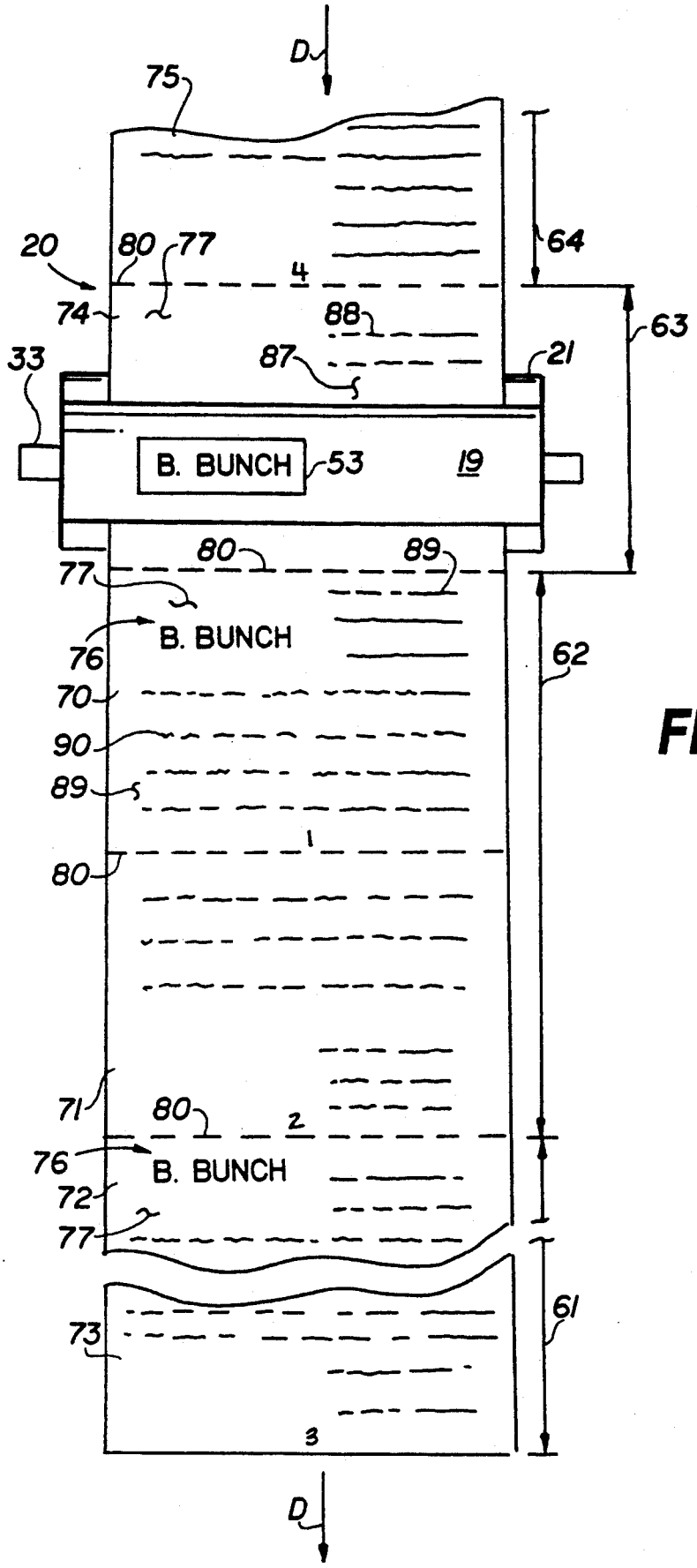
FIG. 5 is a top view illustrating pre-printed business forms and company names imprinted on a web in accordance with the principles of the invention.

In FIG. 5, the area on the page indicated by reference character 74 which will be imprinted with fixed data 76 on plate 53 is generally indicated by reference character 77. The pages 75, 74, 70, 71, 72, 73 in FIG. 5 have each passed through printer 50 and are traveling away from printer 50 in the direction of arrow D. Plate 53 imprints the fixed data or company name "B. BUNCH" 76 in area 77 of selected pages of web 20 as the web moves intermediate rollers 19 and 21. The area in which printer 50 pre-printed information 88 on page 74 is indicated by reference character 87. Similarly, the area in which printer 50 pre-printed information 90 on page 70 is indicated by reference character 89 in FIG. 5. Each page 74, 75, 70 to 73 in web 20 is bounded at either end by lines of weakening 80. The pages are attached end-to-end along the lines of weakening. If desired, the lines of weakening 80 need not be formed in web 20 and the pages would still, for the purposes of this disclosure, be deemed to be attached end-to-end. Plate 53 imprinted the fixed data "B. BUNCH" 76 on the pages indicated by reference characters 70 and 72 and will, as noted, imprint "B. BUNCH" 76 on area 77 of the page indicated by reference character 74 in FIG. 5. "B. BUNCH" 76 is imprinted on a page when roller 21 is upwardly displaced in the direction of arrow E to press web 20 against plate 53. When web 20 is pressed against plate 53, ink on the raised engraved portions of the plate transfers to web 20.

If desired, the area 77 in which plate 53 will imprint each page can be moved up or down the page by providing means for advancing or retarding roller 19 with respect to the speed of travel of web 20. For example, momentarily retarding roller 19 and then letting roller 19 resume its normal speed of rotation will raise toward the top of each page the location 77 in which fixed data is printed. When roller 19 moves at its normal speed of rotation, plate 53 is moving at the same speed as web 20. As long as plate 53 is moving at the same speed as web 20, the location on each page at which plate 53 imprints the page is identical for each such imprinted page.

In FIG. 5, plate 53 imprints a company name in the same area on each page for which printer 19, 21 receives a placement signal from printer 50. Area 77 is in the upper left hand corner of pages 70 and 72. As would be appreciated by those of skill in the art, plate 53 can, by changing the position of plate 53 on roller 19 and/or advancing the rotation of roller 19, imprint the company name or other fixed data in the same area in the upper right hand corner of each page for which printer 19, 21 receives a placement signal from printer 50, can imprint the company name or other fixed data in the same area in the center of each page for which printer 19, 21 receives a placement signal from printer 50, can imprint the company name or other fixed data in the same area in the lower right hand corner of each page for which printer 19, 21 receives a placement signal from printer 50, etc. Consequently, plate 53 can be positioned on roller 19 to print data in the upper right hand corner of a page, plate 53A be positioned on roller 19B to print information in the upper left hand corner of a page, and plate 53B can be positioned on roller 19B to print information in the center of the page. Any number of plate printers can be used in sequence before or after web 20 enters printer 50, but one to three plate printers 19, 21 are presently preferred. Each plate 53, 53A, 53B can, if desired, be engraved to imprint the same fixed data (i.e., "B. BUNCH") and each plate printer 19–21, 19A–21A, and 19B–21B provided with a different color of ink such that the fixed data can be imprinted on any selected page along web 20 in one of the three colors.

In FIG. 5, reference character 62 indicates a job or document which is two pages in length. Page 70 is the first page of the job and page 71 is the second page of the job. Arrows 63 indicate a job or document which is one page in length. Page 74 is the only page in the job indicated by arrows 63. Arrows 61 indicate a job or document which is three pages in length. Page 72 is the first page of job 61. Page 73 is the third and last page of job 61. Arrows 64 indicate a job or document which is four pages in length. Page 75 is the fourth and final page in the job 64. In the example shown in FIG. 5, the fixed data "B. BUNCH" is only printed on the first page of each job or document. If desired, the fixed data "B. BUNCH" 76 can be printed in each page, on every second page, on every third page, on randomly selected pages, etc. simply by having the control unit for the printers 50 and 19, 21 so direct plate printer 19, 21. Further, plate printer 19A, 21A can similarly print a logo or any other desired auxiliary fixed data engraved in plate 53A at a desired location on each page in web 20, on every other page, or on any randomly selected page designated by the control unit of printer 50 (or printer 19B, 21B). This random printing capability of the invention is desirable because the jobs printed by printer 50 on web 20 typically are of varying length and only require that the company name or other auxiliary information be printed on the first page of the job.

Since each of the three plate printers shown in FIG. 1 can be provided with ink of a different color, printing different colors on the pre-printed forms produced by laser printer 50 is also a simple matter.

The plate printers 19A, 21A are on line with printer 50 and readily permit web 20 to travel through printer 50 and the plate printers at speeds in excess of 200 feet per minute, typically at least 220 feet per minute.

Figure 6:
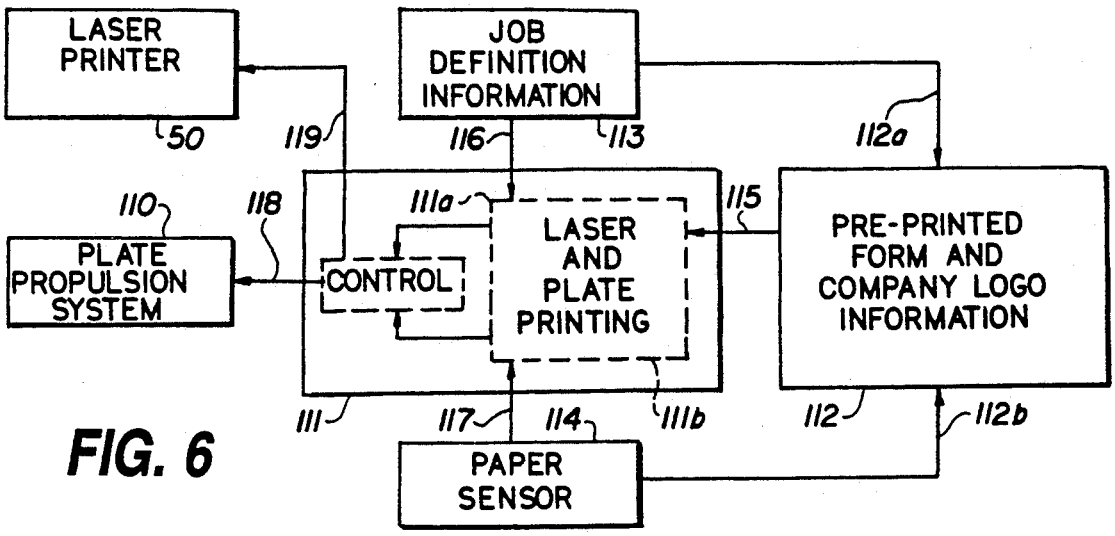
FIG. 6 is a block diagram illustrating an improved printing control system utilized in the present invention.
Figure 7:
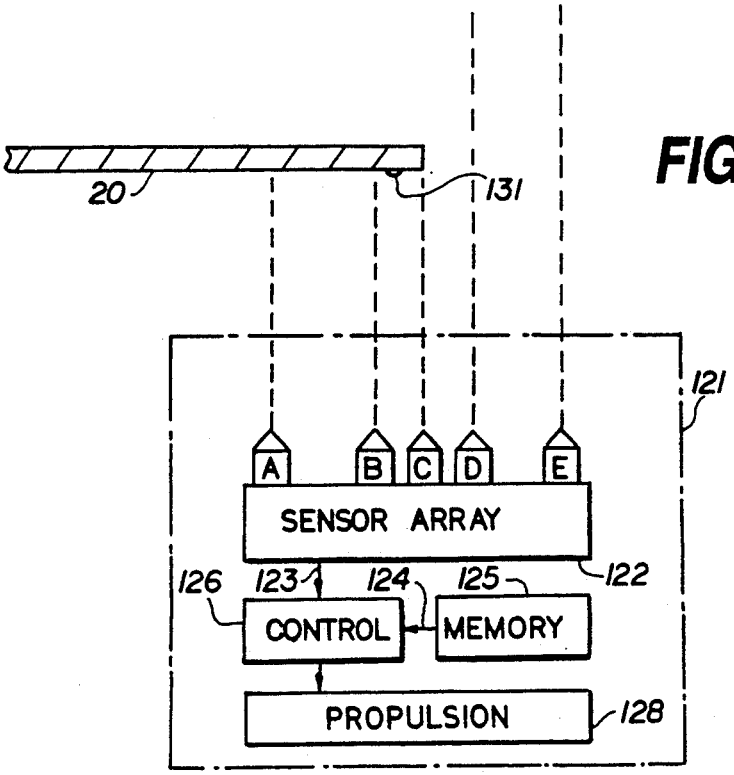
FIG. 7 is a paper sensor which can be employed in the control system of FIG. 6.
Figure 8:
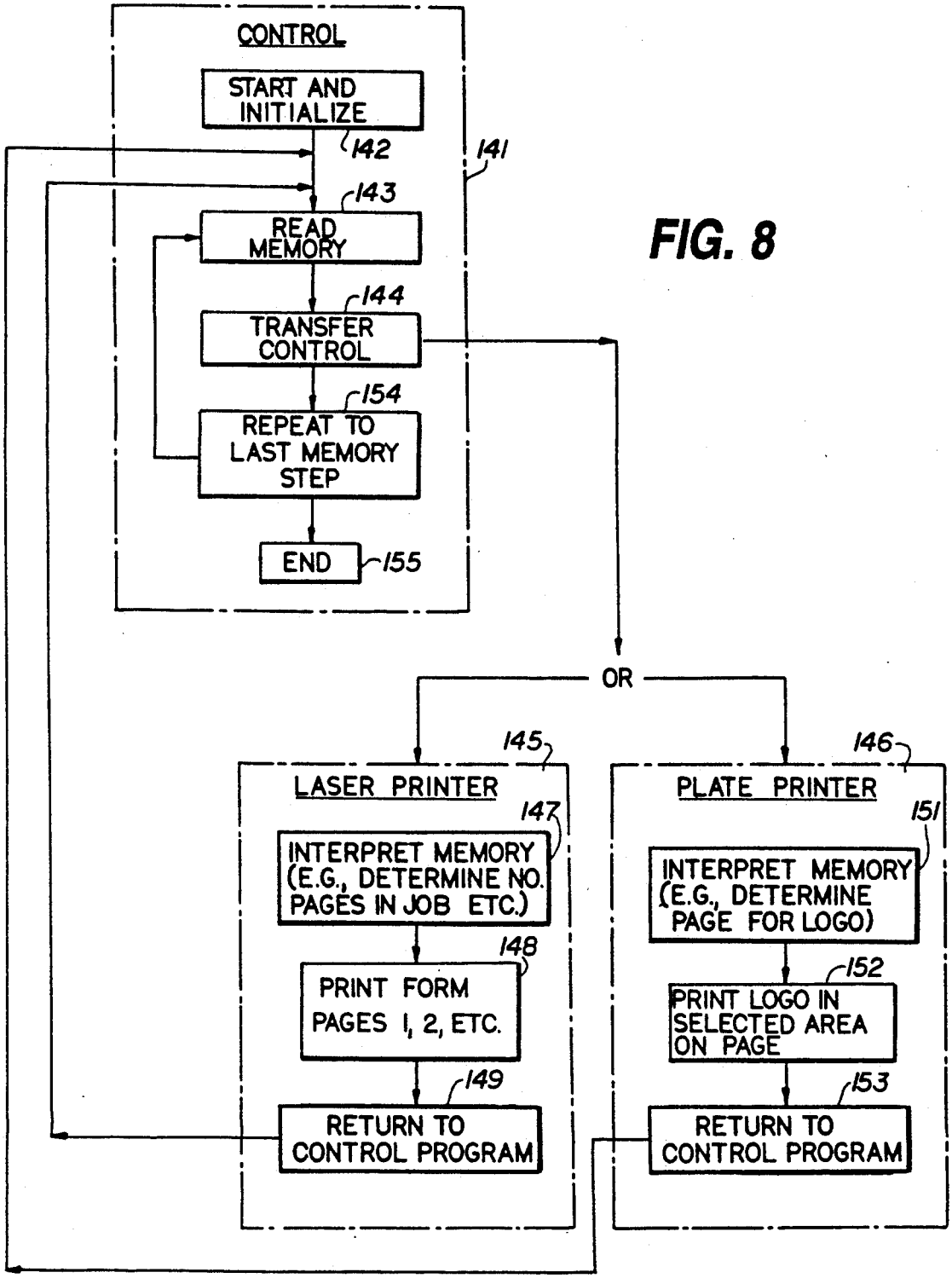
FIG. 8 is a block diagram which illustrates a typical program or logic function utilized in accordance with the control system of FIG. 6.

An automated embodiment of the control system used in the printing apparatus of the invention is illustrated in FIGS. 6 to 8. FIG. 6 is a block diagram which illustrates a preferred embodiment of an improved control system utilized in the invention, the main components of which are a plate propulsion system 110, a laser printer 50, a controller 111 for the laser printer and plate propulsion system, and a memory 112. Means 113 for inputting 112*a* job definition information and a paper sensor 114 are provided. The means 113 for inputting job definition information is presently preferably a mainframe computer which prepares binary or other information defining a business form or other document which is to be printed by laser printer 100 and the plate-printer(s) 19, 21 illustrated in FIGS. 1 to 4. The job definition information includes a description of the letters, numbers, or other images which are to be printed on a web 20 by printer 50 and includes a designation of the page on which plate printer 19, 21 is to apply a company name, logo, or other information engraved or formed on plate 53. The job definition information can, if desired, include more specific instructions concerning the positioning and composition of the company name or other auxiliary images on a page of web 20. The plate propulsion system comprises the apparatus (not shown) used to raise at selected times roller 21 from the position shown in FIG. 2 to press web 20 against plate 53 and to then lower roller 21 back to the normal operative position illustrated in FIG. 2. Any desired means can be used to raise and lower roller 21, including manually controlled linkage means. Or, plate 53 can be mounted on means other than a roller which permits the plate 53 to be reciprocated between a normal storage position spaced apart from web 20 and an imprint position with plate 53 pressed against web 20. It is only important that some means be provided to press plate 53 against a desired defined area of a selected page(s) along the length of web 20 when said defined area in is the printer 19, 21 adjacent plate 53.

If desired, a microprocessor can be utilized in place of a mainframe computer 60 to input job definition information to controller 111.

Paper sensor 114 can be used in place of or to supplement the incremental and decremental counting utilized by printer 19, 21 to monitor the location of each page on web 20 dispensed by laser printer 50. Sensor 114 detects reference points on web 20 and monitors the speed at which the web is moving from printer 50 to plate printer 19, 21. Sensor 114 can be an optic sensor or any other desired prior art sensor which generates signals indicating the speed at which web 20 is moving. Signals from sensor 114 are input 112*b* to memory 112 and controller 111. In one embodiment of the invention, a strip which is sensitive to ultraviolet light is painted on each page or selected pages of web 20 as web 20 leaves printer 50. An ultraviolet light and sensor are then used to detect the location of the page before the page enters printer 19, 21. This method is advantageous because there are over forty different types of cue marks and because conventional electric eyes which are used to pick up a cue mark generated on a page by the laser printer or other printer are expensive and are not necessarily that reliable because the cue mark is difficult to pick up, because the web stretches, etc. At the point at which a page in the web 20 exits printer 50 the web is tight (is tensioned so it does not sag) and the distance from the exit point to a line of weakening in the paper is known; the distance to a line of weakening typically being fifteen to eighteen lines, where a line equals the height (but not the length) of the space which receives a line of print. Therefore, the distance from the exit point to any point on the page is known with respect to the exit point. If at that exit point a spot or line of invisible ink is sprayed on a page in the web 20, the location of the invisible ink is therefore known and a black light can be used to cause the spot to fluoresce so the spot can be detected. Once the spot is detected, then a printer 19, 21 knows the distance to an upcoming area on the page. When the printer knows the distance and the speed of travel of the web 20, the printer 19, 21 knows when the desired area on a page is passing through the printer 19, 21 and knows when plate 53 can be pressed against the page. Or, conversely, the foregoing black light sensing system can be utilized to inform a paper cutting apparatus when a line of weakening is in position in the paper cutting apparatus to be partially or completely severed.

After the pre-printed form and company logo information 112*a* are stored in the memory 112, during subsequent operation cycles this information can be recalled from memory 112 and the recalled information is fed 115 to the controller 11, and used in the laser printer sub-routine 145 to generate printing format signals 119 to print the pre-printed form information on web 20 and used in the plate printer sub-routine 146 to generate printing format signals 118 to cause plate printer 19, 21 to use plate 53 to imprint the web 20 at a desired location on a page. The job definition information 113 and paper sensor information 114 are also directly fed 116, 117 to the controller 111. The controller 111 generates printing format signals 118 which are fed to the propulsion system 110 of the plate printer 19, 21 and generates printing format signals 119 which are fed to laser printer 50.

The memory 112 contains pre-printed form information 112*a* for the printer 50 and company logo or other selected information 112*b* for the plate printer 19, 21. The pre-printed form information includes the number of pages in a job and the information to be printed on web 20 moving through printer 50. The company logo information 112*b* can simply comprise the page(s) on which the company logo or other information is to be printed by plate printer 19, 21, and can, if desired, include other additional information concerning the location of the logo on a page, etc.

The plate propulsion system 110 can be any suitable system for providing motive power to move the plate 53 between a normal storage operative position spaced away from web 20 and a displaced imprint position pressed against web 20.

The memory 112 can be any suitable prior art memory unit such as are commonly used in industrial machines, numerical control machines, etc. For example, electromagnetic memories such as magnetic, optical, solid state, etc. or mechanical memories such as paper tape can be used.

A sensor which can be employed in accordance with the control system of FIGS. 6 to 8 is illustrated schematically in FIG. 7. The sensor array 122 is mounted on a printer 19, 21 or is mounted at any appropriate fixed location along the path of travel of web 20. The output 123 of array 122, along with information 124 recalled from the memory 125, is processed in the controller 126 to provide command signals 127 to the propulsion system 128 of a plate printer 19, 21. The sensor array 122 can comprise one or more optic sensors or other sensors and can comprise a plurality of sensors A-E mounted in the manner shown in FIG. 7.

The sensor array 122 can be a series of mechanically operated switches, ultrasound range detectors or any other suitable sensor which detects the proximity of a selected reference point 131 on web 20 moving by the sensor array.

Figure 9:
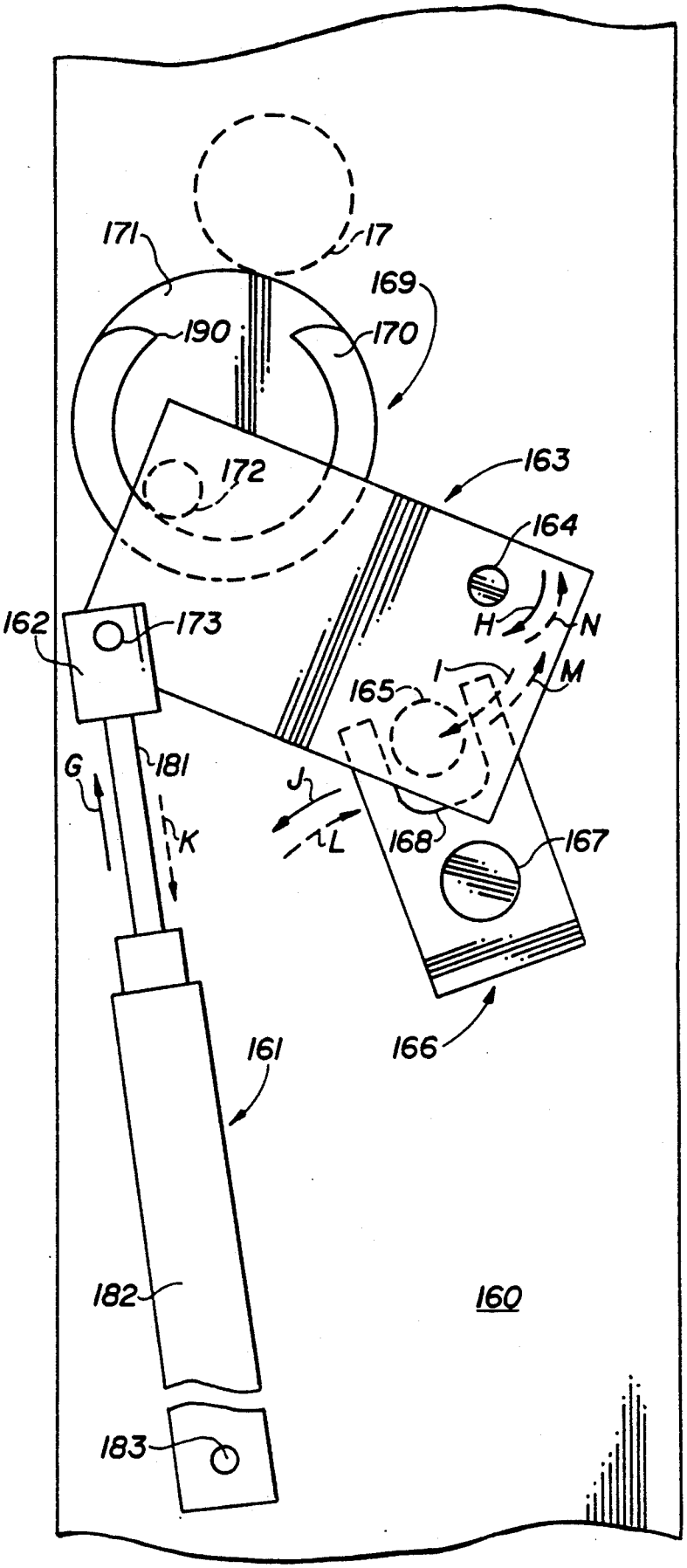
FIG. 9 is a side elevation view illustrating a plate propulsion system constructed in accordance with the invention.

FIG. 9 is a block flow diagram which illustrates a typical program or logic function which is executed by the controller 111 for operating the laser printer 50 and plate printer 19, 21. The basic control program 141 consist of commands to "start and initialize" 142, "read memory" 143 and "transfer control" 144 to the laser printer sub-routine 145 or plate printer sub-routine 146. The laser printer sub-routine 145 consist of commands to "interpret memory" 147 (i.e., determine the number of pages in a job and the images to be printed on the pages) and "print form" 148 (i.e., print the job on pages of the web 20 moving through the laser printer). Command 148 is followed by "return to control program" 149. The laser printer sub-routine 145 is repeated as indicated by the "repeat to last memory step" 154 of the control program 141.

The plate printer sub-routine 146 consists of commands to "interpret memory" 151 (i.e., determine the page on which the logo is to be printed and determine whether the page is in position in the plate printer) and "print logo" 152 in the selected area on the designated page. Command 152 is followed by "return to control program" 153. The plate printer sub-routine 146 is repeated as indicated by the "repeat to last memory step" 154 of the control program 141 followed by an "end" program command 155 which completes the execution of the program.

In use, a web 20 is fed into the laser printer 50 and job definition information is provided controller 111 by computer 60. The controller 111 generates printing format signals 119 which direct printer 50 to imprint the job on the number of pages required to complete the job. The controller 111 also generates printing format signals 118 to the plate propulsion system of plate printer 19, 21 which enables the plate printer to determine which selected page(s) of the job must be imprinted by plate 53 and when the page(s) is in the proper position in plate printer 19, 21 to be imprinted by plate 53. When a selected page along web 20 is in position in plate printer 19, 21, plate 53 is displaced against the page (or vice versa) to imprint on the page the image engraved or formed in plate 53. In addition to imprinting a page by apply ink to the page, plate 53 is deemed to imprint a page when plate 53 embosses the page.

As earlier noted, each roller 19, 19A and 19B is presently sized such that its associated plate 53, 53A, 53B moves through one revolution with the roller each time a page passes intermediate the roller and its opposing roller 21, 21A, 21B. If desired, each roller 19, 19A, 19B can be sized to make two or more revolutions each time a page passes beneath the roller or can be sized to make only a partial revolution each time a page passes beneath the roller.

In FIG. 1, plate imprinter 19, 21 is on-line with laser printer 50. Imprinter 19, 21 is on-line with printer 50 because web 20 simultaneously moves through the plate printer 19, 21 and printer 50. Web 20 is deemed to simultaneously move through plate printer 19, 21 and printer 50 because portions of continuous web 20 normally move through plate printer 19, 21 at the same time that portions of continuous web 20 are moving through printer 50.

One problem encountered in utilizing the apparatus illustrated in FIG. 1 is insuring that an "impression" roller 21 is upwardly displaced in the direction of arrow E at the proper time to press the web 20 against a plate 53 on a "plate" roller 19. If the upward displacement of roller 21 is tardy, then plate 53 applies ink to a location on a sheet or page in web 20 which is below or lower than the desired location. If roller 21 is upwardly displaced too soon, then ink can be applied to a location on a sheet or page which precedes the desired location. Properly timing the upward displacement of roller 21 becomes more difficult as the speed at which the web 20 is moving increases. The apparatus illustrated in FIGS. 9 to 12 permits a roller 21 to be upwardly displaced against a plate roller at a desired instant in time so that the image on the plate 53 is imprinted on web 20 at the desired location.

Figure 10:
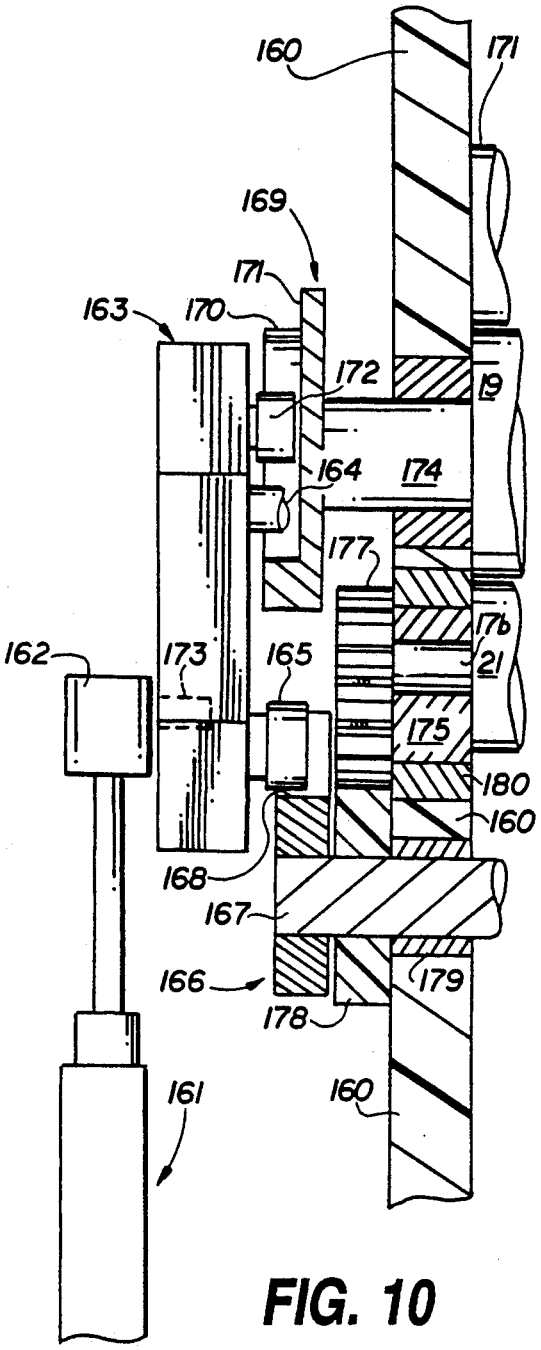
FIG. 10 is a side section view illustrating the plate propulsion system of FIG. 9.
Figure 11:
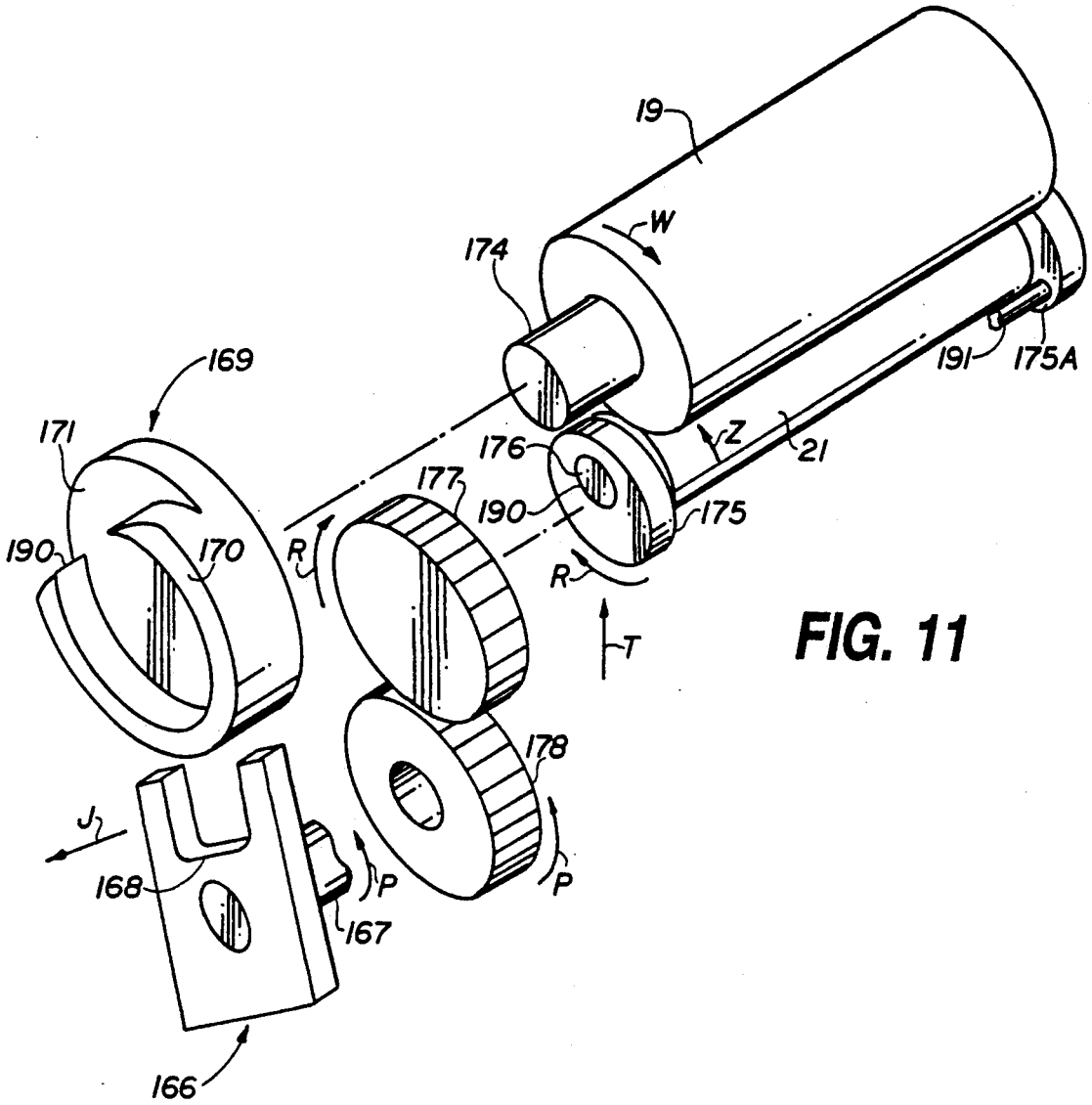
FIG. 11 is an exploded perspective assembly view of portions of the plate propulsion system of FIG. 9.

In FIGS. 9, 10 and 11, roller 19 is fixedly mounted on shaft 174. The end of shaft 174 extending from one end of roller 19 is journalled for rotation in side wall 160. The other end of shaft 174 (not visible in FIGS. 9, 10, and 11) extending from the other end of roller 19 is journalled for rotation in a second side wall (not visible in FIGS. 9, 10, and 11) which is parallel to and spaced apart from wall 160. The second side wall is spaced apart from wall 160 a distance which is approximately equal to the length of rollers 19 and 21. Circular cam member 175 is also journalled for rotation in bushing 180 in wall 160. Roller 21 is fixedly mounted on shaft 176. The end of shaft 176 extending from one end of roller 21 is rotatably received by cam member 175. The other end of shaft 176 (not visible in FIGS. 9, 10, and 11) extending from the other end of roller 21 is rotatably received by a cam member 175A journalled for rotation in said second side wall. Cam members 175 and 175A are of equal shape and dimension and are interconnected by at least one elongate shaft 191 so that when cam member 175 rotates, cam member 175A rotates simultaneously with member 175 and in the same direction as member 175. Gear 177 is fixedly attached to member 175. Cylindrical gear 178 is fixedly mounted on shaft 167. Shaft 167 extends from member 166 through gear 178, through wall 160, and to and into said second side wall referred to above. Shaft 167 is journalled for rotation in bushing 179 of wall 160 and is journalled for rotation in the second side wall.

Cam member 169 is fixedly attached to and rotates in the direction of arrow W with the end of shaft 174 extending outwardly from wall 160. Member 169 includes circular surface 171 and semi-circular lip or edge 170 extending outwardly from surface 171. Edge 170 includes at least one opening 190. Fork member 166 includes U-shaped groove 168 formed therein. Member 166 is fixedly attached to and rotates with shaft 167. Roller 165 is received by groove 168 and is attached to rectangular plate 163. Roller 172 is also attached to plate 163.

Plate 163 is pivotally attached to shaft 164. Shaft 164 is fixedly attached to wall 160. End 162 of pneumatic piston 161 is pivotally attached to plate 163 by pin 173. Piston 161 is operated in well known fashion to displace shaft 181 and end 162 in the directions indicated by arrows G and K with respect to housing 182 of piston 161. A control system (not shown) is provided which operates pneumatic piston 161 to displace shaft 181 in the direction of arrows G and K in response to signals 118 received from a controller 111 (FIG. 6). The lower end of housing 182 is pivotally attached to wall 160 by pin 183. Piston 161 can be operated using hydraulic fluid or any other means.

Pneumatic piston 161, plate 163, rollers 165 and 172, member 166, cam member 169, shaft 167, shaft 164, gears 177 and 178, cam members 175 and 175A all comprise one embodiment of the plate propulsion system 110 earlier referred to in connection with FIG. 7.

In use of the apparatus in FIGS. 9 to 12, roller 21 is normally spaced apart from roller 19 such that web 20 passing intermediate the rollers (FIG. 2) is not pressed against plate 53 and imprinted. When roller 21 is spaced apart from roller 19, roller 172 remains in the position shown in FIG. 12A and there is no upward pressure, like the upward pressure indicated by arrow U in FIG. 12A, exerted against roller 172 by pneumatic piston 161. When the pneumatic piston 161 control system receives a printing format signal 118, piston 161 is pneumatically operated to force shaft 181 in the direction of arrow G and displace plate 163 and roller 172 in the direction of arrow U in FIG. 12A. As earlier described, controller 111 and the piston 161 control system determine and know when a particular location on the web 20 will pass intermediate rollers 19 and 21. Consequently, signal 118 is used to activate the piston 161 at the time necessary to cause plate 53 to imprint web 20 at said desired location.

Figure 12A:
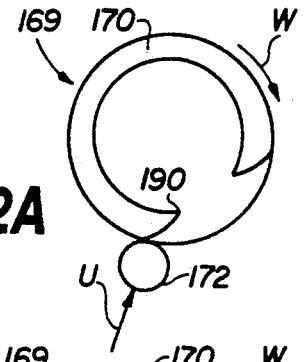
FIGS. 12A to 12C are schematic views illustrating the mode of operation of the plate propulsion system of FIGS. 9 to 11; and, FIG. 13 is an exploded perspective assembly view of an alternate embodiment of a plate propulsion system constructed in accordance with the principles of the invention.

When a force is generated on roller 172 in the direction of arrow U, roller 172 is pressed against the outside of lip 170 in the manner illustrated in FIG. 12A until opening 190 passes in front of roller 172. As soon as opening 190 passes in front of roller 172, piston 161 presses roller 172 through opening 190 in the manner illustrated in FIG. 12B. When roller 172 passes through opening 190 in the direction of arrow U, plate 163 is displaced in the direction of arrow U. When plate 163 moves in the direction of arrow U, plate 163 pivots about pin 164 in the direction indicated by arrow H in FIG. 9. When plate 163 pivots in the direction of arrow H, roller 165 moves in the direction of arrow I, contacts U-shaped opening 168, and causes fork member 166 and shaft 167 to pivot in the direction indicated by arrow J in FIG. 9. When member 166 pivots in the direction of arrow J, shaft 167 and gear 178 simultaneously rotate in the direction of arrow P. When gear 178 rotates in the direction of arrow P, it engages and causes gear 177 to rotate in the direction of arrow R. Since gear 177 is attached to cam member 175, member 175 simultaneously rotates with gear 177 in the direction of arrow R. The end of shaft 176 carried in cylindrical member 175 is rotatably housed in a cylindrical opening 190 offset from the center point of member 175. In other words, the inner cylindrical surface of opening 190 is not concentric with the outer cylindrical surface of member 175. The eccentric mounting of the end of shaft 176 in member 175 allows shaft 176, and roller 21, to be upwardly displaced toward roller 19 to press the web against plate 55.

Figure 12B:
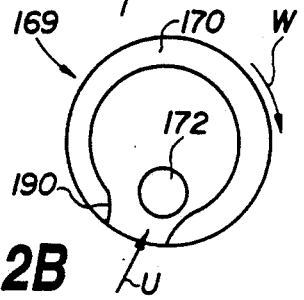
Figure 12C:
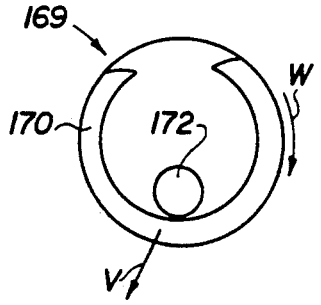

Returning to FIG. 12C, after roller 172 is displaced through openings 190 in the manner shown in FIG. 12B, the piston 161 is operated to pull shaft 181 in the direction of arrow K. This generates a force on roller 172 in the direction of arrow V and presses roller 172 against the inner cylindrical surface of lip 170 in the manner illustrated in FIGS. 9, 12C, and 10. Roller 172 continues to press against the inner surface of lip 170 until mouth 190 returns to the position shown in FIG. 12B, at which time piston pulls roller 172 through mouth in the direction of arrow V to the position shown in FIG. 12A. When roller 172 passes though mouth 190 in the direction of arrow V, shaft 181 moves in the direction of arrow K, plate 163 pivots about pin 164 in the direction of arrow N, roller 165 moves in the direction of arrow M and displaces member 166 in the direction of arrow L, shaft 167 and gear 178 rotate in a direction opposite that indicated by arrow P, and gear 178 causes gear 177 and member to rotate in a direction opposite that of arrow R. When member 175 rotates in a direction opposite that of arrow R in FIG. 11, shaft 176 and roller 21 are displaced downwardly away from roller 19 such that web passing intermediate rollers 19 and 21 is not pressed against plate 55 on roller 19.

The mechanical system of FIGS. 9 to 12 enables roller 21 to be repeatedly pressed against and displaced away from plate 55 with a high degree of accuracy. When web 20 is moving between rollers 19 and 21 at speeds in the range of about 150 to 200 feet per minute, the system of FIGS. 9 to 12 can imprint the image produced by plate 55 at a desired location on the web 20 to within a tolerance of about one-eighth of an inch or better. In FIGS. 11 and 12, roller 19 normally continuously rotates in the direction of arrow W at a selected speed. Roller 21 continuously rotates in the direction of arrow Z at a selected speed. Rollers 19 and 21 are driven rollers. Shaft 167 is not driven and only turns when member 166 is displaced by roller 165.

In FIGS. 9 to 12, the roller 21 is displaced against roller 19. As would be appreciated by those of skill in the art, the mechanical system of FIGS. 9 to 12 could be designed to instead displace roller 19 against roller 21.

Figure 13:
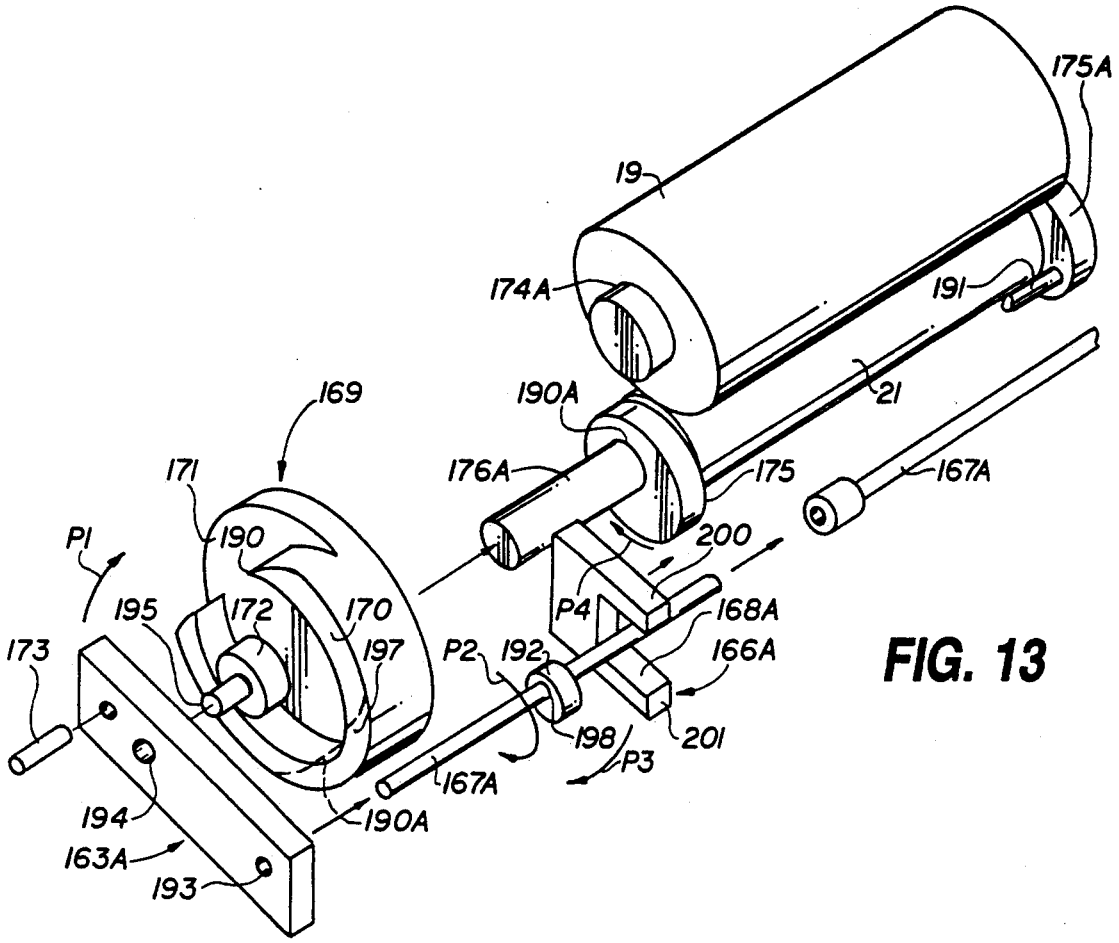

An alternate embodiment of the mechanical system of FIGS. 9 to 12 is illustrated in the exploded assembly view of FIG. 13. Although in FIG. 13 roller 21 is illustrated as having a smaller diameter than roller 19, in the embodiment of the system shown in FIG. 13, roller 21 preferably has a diameter equal to the diameter of roller 19. In FIG. 13 roller 19 is fixedly mounted on and simultaneously rotates with shaft 174A. The ends of shaft 174A extending outwardly from the ends of roller 19 are journalled in a side wall 160 and in a second side wall parallel to and spaced apart from wall 160. Roller 21 is fixedly mounted on and simultaneously rotates with shaft 176A. Member 175 is journalled for rotation in wall 160. Member 175A is journalled for rotation in the second side wall which is parallel to and spaced apart from wall 160. Members 175 and 175A are interconnected by shaft 191. Fork member 166A is fixedly attached to and simultaneously pivots with member 175. Cam member 169 is fixedly attached to and continuously rotates with shaft 176A. Cylindrical cam 192 is mounted on and simultaneously turns with cylindrical shaft 167A. Shaft 167A is not a driven shaft and only turns when plate 163A is displaced. Shafts 174A and 176A are driven shafts which continuously rotate. Shaft 167A passes through cylindrical aperture 198 in cam 192. Aperture 198 is eccentric to the outer cylindrical surface of cam 192. In other words, the center of cylindrical aperture 198 and the longitudinal axis of shaft 167A each are offset from the center of cam 192, in the same manner that the longitudinal axis of shaft 176 is offset from the center of cylindrical member 175 in FIG. 11. Roller 172 is rotatably mounted on pin 195. Pin 195 is fixedly secured in aperture 194 of rectangular plate 163A. Plate 163A is fixedly secured to the end of shaft 167A received by aperture 193. Pin 173 pivotally secures the upper end 162 of a piston 161 (not shown in FIG. 13) to plate 163A.

Operation of the apparatus illustrated in FIG. 13 is similar to operation of the apparatus depicted in FIGS. 9 to 12. In FIG. 13, roller 172 is normally outside of lip 170 in a position similar to that shown in FIG. 12A and roller 21 is normally spaced apart from roller 19 such that web 20 passing intermediate the rollers (FIG. 2) is not pressed against plate 53 and imprinted. When roller 21 is spaced apart from roller 19, roller 172 remains in the position shown in FIG. 12A and there is no upward pressure, like the upward pressure indicated by arrow U in FIG. 12A, exerted against roller 172 by pneumatic piston 161. When the pneumatic piston 161 control system receives a printing format signal 118, piston 161 is pneumatically operated to force shaft 181 in the direction of arrow G and to generate a force against pin 173 and plate 163 in the direction of arrow P1 in FIG. 13 and to generate a force against roller 172 in the direction of arrow U in FIG. 12A. When a force U is generated on roller 172, roller 172 is pressed against the outside of lip 170 in the manner illustrated in FIG. 12A until opening 190 passes by roller 172. As soon as opening 190 passes by roller 172, piston 161 presses roller 172 through opening 190 in the manner illustrated in FIG. 12B. When roller 172 passes through opening 190 in the direction of arrow U, plate 163A is displaced in the direction of arrow P1. When plate 163A moves in the direction of arrow P1, plate 163A pivots shaft 167A and cam 192 in the direction indicated by arrow P2 in FIG. 13. The diameter of cylindrical cam 192 equals the shortest distance between fingers 200 and 201 of member 166A. The outer cylindrical surface of cam 192 is normally positioned between and continuously contacts points on fingers 200 and 201. As a result, when shaft 167A and cam 192 simultaneously rotate in the direction of arrow P2, member 166A is displaced by eccentric cam 192 and rotates in the direction of arrow P3. When member 166A rotates in the direction of arrow P3, member 175 simultaneously turns in the direction of arrow P4. The end of shaft 176A carried in cylindrical member 175 is rotatably housed in a cylindrical opening 190A offset from the center point of member 175. In other words, the inner cylindrical surface of opening 190A is not concentric with the outer cylindrical surface of member 175. The eccentric mounting of the end of shaft 176A in member 175 allows shaft 176A, and roller 21, to be upwardly displaced toward roller 19 to press the web 20 against plate 55 when member 175 is rotated in the direction of arrow P4.

Returning to FIG. 12C, after roller 172 is displaced through openings 190 in the manner shown in FIG. 12B, the piston 161 is operated to pull shaft 181 in the direction of arrow K. This generates a force on roller 172 in the direction of arrow V and presses roller 172 against the inner cylindrical surface of lip 170. Roller 172 continues to press against the inner surface of lip 170 until mouth 190 returns to the position shown in FIG. 12B, at which time piston pulls roller 172 through mouth in the direction of arrow V to the position shown in FIG. 12A. When roller 172 passes though mouth 190 in the direction of arrow V, cam 192 rotates in a direction opposite that of the direction indicated by arrow P3 and shaft 176 and roller 21 are displaced downwardly away from roller 19 such that web passing intermediate rollers 19 and 21 is not pressed against plate 55 on roller 19.

Having described my invention in such terms as to enable those skilled in the art to understand and practice it, and having identified the presently preferred embodiments thereof,

I claim:

1. Plate printing apparatus for printing images on a web passing through said apparatus and comprising a plurality of pages attached end-to-end, said apparatus including (a) frame means;

(b) a reservoir of ink mounted on said frame means;

(c) an imprint roller rotatably mounted on said frame means and including at least one plate means for imprinting an image on the web, said imprint roller and said plate means normally being spaced apart from the web;

(d) control means for receiving instructions defining where on the web said image is to be imprinted and for generating printing format signals specifying at least one selected location on the web at which said image is to be imprinted;

(e) means mounted on said frame means for transferring ink from said reservoir to said plate means on said imprint roller;

(f) an impression roller rotatably mounted on said frame means for intermittently pressing the web passing intermediate said imprint roller and impression roller against said plate means, said impression roller normally being spaced apart from said imprint roller;

(g) activation means mounted on said frame means and responsive to said printing format signals to displace at least one of the roller pair comprising
said imprint roller, and
said impression roller,
to press said web against said plate means and imprint said image on the web at said selected location, said activation means including (i) rotatable eccentric means contacting said one of said pair to displace said one of said pair when said eccentric means rotates, and (ii) tracking means for rotating said eccentric means to displace one of said pair with respect to the other of said pair, said tracking means including a rotating arcuate track (170) with at least one opening (190) formed therethrough and including an outer tracking surface and an inner tracking surface, a roller follower (172), and means for preloading said roller follower (172) to press against said outer tracking surface such that when said arcuate track (178) rotates sufficiently for said opening (190) to reach said roller follower (172), said roller follower is immediately displaced through said opening to turn said rotatable eccentric means.

2. Plate printing apparatus for printing images on a web passing through said apparatus and comprising a plurality of pages attached end-to-end, said apparatus including (a) frame means;

(b) a reservoir of ink mounted on said frame means;

(c) an imprint roller rotatably mounted on said frame means and including at least one plate means for imprinting an image on the web, said imprint roller and said plate means normally being spaced apart from the web;

(d) control means for receiving instructions defining where on the web said image is to be imprinted and for generating printing format signals specifying at least one selected location on the web at which said image is to be imprinted;

(e) means mounted on said frame means for transferring ink from said reservoir to said plate means on said imprint roller;

(f) an impression roller rotatably mounted on said frame means for intermittently pressing the web passing intermediate said imprint roller and impression roller against said plate means, said impression roller normally being spaced apart from said imprint roller;

(g) activation means mounted on said frame means and responsive to said printing format signals to displace at least one of the roller pair comprising said imprint roller, and said impression roller, to press said web against said plate means and imprint said image on the web at said selected location, said activation means including (i) rotatable eccentric means contacting said one of said pair to displace said one of said pair when said eccentric means rotates, and (ii) tracking means for rotating said eccentric means to displace one of said pair with respect to the other of said pair, said tracking means including a rotating arcuate track (170) at least partially circumscribing an inner area and including at least one opening (190) formed therethrough accessing said inner area, an outer tracking surface, and an inner tracking surface, a roller follower (172) moveable between at least three operative positions, a first operative position with said roller follower contacting said outer tracking surface of said track (170), a second operative position after said roller follower is displaced through said opening into said inner area, and a third operative position with said roller follower (172) contacting said inner tracking surface of said track (170) means for pressing said roller follower (172) against said outer tracking surface when said roller follower (178) is in said first operative position such that when said track (178) rotates sufficiently for said roller follower (172) to reach said opening (190), said roller follower is immediately displaced through said opening to said second operative position; and, means for displacing said roller follower (172) from said second to said third operative position and for pressing said follower (172) against said inner tracking surface when said roller follower is in said third operative position;

said roller follower being operatively associated with and rotating said eccentric means when said roller follower is displaced through said opening (190) from said first to said second operative position.

3. Plate printing apparatus for printing images on a web passing through said apparatus and comprising a plurality of pages attached end-to-end, said apparatus including (a) frame means;

(b) a reservoir of ink mounted on said frame means;

(c) an imprint roller rotatably mounted on said frame means and including at least one plate means for imprinting an image on the web, said imprint roller and said plate means normally being spaced apart from the web;

(d) control means for receiving instructions defining where on the web said image is to be imprinted and for generating printing format signals specifying at least one selected location on the web at which said image is to be imprinted;

(e) means mounted on said frame means for transferring ink from said reservoir to said plate means on said imprint roller;

(f) an impression roller rotatably mounted on said frame means for intermittently pressing the web passing intermediate said imprint roller and impression roller against said plate means, said impression roller normally being spaced apart from said imprint roller;

(g) activation means mounted on said frame means and responsive to said printing format signals to displace at least one of the roller pair comprising said imprint roller, and said impression roller, to press said web against said plate means and imprint said image on the web at said selected location, said activation means including (i) rotatable eccentric means contacting said one of said pair to displace said one of said pair when said eccentric means rotates, and (ii) tracking means for rotating said eccentric means to displace one of said pair with respect to the other of said pair, said tracking means including a rotating arcuate track (170) at least partially circumscribing an inner area and including at least one opening (190) formed therethrough accessing said inner area, an outer tracking surface, and an inner tracking surface, an arm (163A) pivotally mounted on said printing apparatus and operatively associated with said rotatable eccentric means, a roller follower (172) rotatably mounted on said arm (163A), said arm and follower being moveable between at least three operative positions, a first operative position with said roller follower contacting said outer tracking surface of said track (170), a second operative position in said inner area after said arm is pivoted and said roller follower is displaced from said first operative position through said opening into said inner area, and a third operative position with said follower (172) contacting said inner tracking surface of said track (170) after said arm is pivoted and said roller follower is displaced from said second operative position toward said inner tracking surface, means for pressing said roller follower (172) against said outer tracking surface when said roller follower (178) is in said first operative position such that when said track (178) rotates sufficiently for said roller follower (172) to reach said opening (190) said roller follower is immediately displaced through said opening to said second operative position; and, means for displacing said roller follower (172) from said second to said third operative position to press said follower (172) against said inner tracking surface;

said arm and roller follower (178) being operatively associated with said eccentric means such that the displacement of said arm from said first to said second operative position causing said eccentric means to rotate to displace said one of said roller pair.

4. Printing apparatus for printing images on a web passing through said apparatus and comprising a plurality of pages attached end-to-end, said apparatus including (a) frame means;

(b) a reservoir of ink mounted on said frame means;

(c) an opposed pair of rollers for imprinting an image on the web, one of said rollers normally being spaced apart from the web;

(d) control means for receiving instructions defining where on the web said image is to be imprinted and for generating printing format signals specifying at least one selected location on the web at which said image is to be imprinted;

(e) means mounted on said frame means for transferring ink from said reservoir to said plate means on said imprint roller;

(f) activation means mounted on said frame means and responsive to said printing format signals to displace at least said one of said roller pair to press said web between said roller pair and imprint said image on the web at said selected location, said activation means including (i) rotatable eccentric means contacting said one of said pair to displace said one of said pair when said eccentric means rotates, and (ii) tracking means for rotating said eccentric means to displace said one of said roller pair with respect to the other of said pair, said tracking means including a rotating arcuate track (170) with at least one opening (190) formed therethrough and including an outer tracking surface and an inner tracking surface, a roller follower (172), and means for preloading said roller follower (172) to press against said outer tracking surface such that when said arcuate track (178) rotates sufficiently for said opening (190) to reach said roller follower (172) said roller follower is immediately displaced through said opening to turn said rotatable eccentric means.

* * * * *